US010145602B2

(12) United States Patent
Shirron et al.

(10) Patent No.: US 10,145,602 B2
(45) Date of Patent: Dec. 4, 2018

(54) ACTIVE GAS-GAP HEAT SWITCH WITH FAST THERMAL RESPONSE

(71) Applicant: The United States of America as represented by the Administrator of the National Aeronautics and Space Administration, Washington, DC (US)

(72) Inventors: Peter J. Shirron, Silver Spring, MD (US); Mark O. Kimball, Chester, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 317 days.

(21) Appl. No.: 14/842,939

(22) Filed: Sep. 2, 2015

(65) Prior Publication Data

US 2017/0059262 A1 Mar. 2, 2017

(51) Int. Cl.

| | |
|---|---|
| ***F28F 27/00*** | (2006.01) |
| ***F28F 7/00*** | (2006.01) |
| ***F25D 19/00*** | (2006.01) |
| *F28F 13/00* | (2006.01) |

(52) U.S. Cl.

CPC ..... *F25D 19/006* (2013.01); *F28F 2013/008* (2013.01)

(58) Field of Classification Search

CPC ..... F28D 15/0258; F28D 19/006; H01L 2023/4068; H01L 2023/4037; F28F 2013/006; F28F 2013/008; F28F 2013/005

USPC ..... 157/157, 275, 185, 276

See application file for complete search history.

(56) References Cited

U.S. PATENT DOCUMENTS

| | | | | |
|---|---|---|---|---|
| 3,830,288 | A * | 8/1974 | Laing | F24H 7/0416 126/400 |
| 4,586,561 | A * | 5/1986 | Franco | C01C 1/024 165/104.27 |
| 4,901,790 | A * | 2/1990 | Meijer | F28D 15/0233 165/104.27 |
| 5,842,348 | A * | 12/1998 | Kaneko | F25D 19/006 335/216 |
| 6,209,625 | B1 * | 4/2001 | Guo | F28D 15/0258 165/104.21 |
| 6,959,554 | B1 * | 11/2005 | Shirron | F25B 21/00 165/275 |
| 2004/0040327 | A1 * | 3/2004 | Iida | H01L 23/367 62/259.2 |
| 2005/0000682 | A1 * | 1/2005 | Chien | F28F 3/02 165/80.3 |
| 2006/0087816 | A1 * | 4/2006 | Ewes | F28F 3/02 361/704 |
| 2007/0284087 | A1 * | 12/2007 | Kohara | F01N 5/02 165/104.14 |

(Continued)

*Primary Examiner* — Jason Thompson

(74) *Attorney, Agent, or Firm* — Christopher O. Edwards; Bryan A. Geurts; Mark P. Dvorscak

(57) ABSTRACT

An active gas-gap heat switch may significantly reduce the time required to transition between the open and closed states, reduce the heat require to warm the getter, and reduce the heat that leaks from the getter to the switch body. A thermal interface at one end of the active gas-gap heat switch may include a plurality of fins. A getter assembly may be hermetically attached to the thermal interface and a containment tube may surround and house the plurality of fins.

4 Claims, 6 Drawing Sheets

(56) References Cited

U.S. PATENT DOCUMENTS

2010/0031693 A1* 2/2010 Yuyama ..... F25D 19/006
62/430

* cited by examiner

ACTIVE GAS-GAP HEAT SWITCH WITH FAST THERMAL RESPONSE

STATEMENT OF FEDERAL RIGHTS

The invention described herein was made by employees of the United States Government and may be manufactured and used by or for the Government for Government purposes without the payment of any royalties thereon or therefore.

FIELD

The present invention generally relates to heat switches, and more particularly, to active gas-gap heat switches with a fast thermal response.

BACKGROUND

Heat switches are used to control the flow of heat in thermal systems, coupling stages of refrigeration. They are critical components of a variety of refrigerators that operate at very low temperature (e.g., less than 5 kelvin (K)), including adiabatic demagnetization refrigerators and helium-3 and helium-4 refrigerators. One of the most common types is the active gas-gap heat switch. In a conventional active gas-gap heat switch, there are two main components: the switch body and the external getter (i.e., sorption pump). The getter is connected to the main switch body.

The switch body contains two sets of thermal conductors located inside a containment tube that maintains a close spacing between the thermal conductors, and positions the thermal conductors such that their surfaces face each other. Each set of thermal conductors is connected at one end to a flange that can be sealed to the containment tube. The two sets of thermal conductors are inserted and sealed to the containment tube from opposite ends. The flanges provide a means to make thermal contact between external components and the thermal conductors inside the switch body. The enclosed volume is hermetically sealed with a quantity of gas, usually helium for low temperature switches, inside. The external getter is a similarly sealed volume that contains a material with large microscopic surface area that, in the desired temperature range, has a high binding energy for the chosen gas.

The switch body and getter are connected so that they form a single enclosed volume, usually by means of the interconnecting tube. The connection is made in a way that allows the getter to be heated and cooled independent of the switch body. The switch is opened and closed by cooling the getter below or warming it above a threshold temperature. When the getter cools below a threshold temperature, gas empties from the switch body and adsorbs onto the getter, opening the switch. Similarly, when the getter is warmed above the threshold, the gas desorbs and the switch closes. In a typical active gas-gap heat switch, the getter material is charcoal or zeolite, the fill pressure is one atmosphere of helium (either helium-3 or helium-4), the temperatures at which the switch is used are less than ~5 K, and the threshold temperature for the getter is 12-13 K. Also, typically, the amount of heat needed to warm the getter is on the order of 1 milliwatt.

The connection between the switch body and the getter presents some significant design challenges. The goal is to have a low gas impedance between the getter and the switch body and a high thermal impedance. The low gas impedance allows the gas to flow quickly between the two volumes, especially at the very low pressures needed for the switch to be truly "open." The low thermal impedance minimizes the flow of heat from the getter when it is warm to the switch body. This flow of heat can be a significant source of inefficiency for low temperature refrigerators using active gas-gap heat switches.

However, these two goals cannot be met simultaneously with conventional switches. Lower gas impedance requires a larger diameter, shorter interconnecting tube, while lower thermal impedance requires a smaller diameter and a longer length. A further goal of any design is for the transition time between open and closed states to be short. This is limited by two factors: (1) the thermal impedance of the interconnecting tube; and (2) the heat capacity of the getter assembly. The first factor arises because, for designs in common use, the only means of cooling the getter is heat flow through the interconnecting tube. In practice, the ratio of heat capacity of the getter to the thermal conductance of the interconnecting tube (conductance is the inverse of impedance) is the time constant for the getter to cool. Hence, a small heat capacity and large, or at least moderate, thermal conductance is desirable. This latter desire is also at odds with the two goals above.

Thus, conventional heat switch designs are not capable of achieving a low gas flow impedance, a high thermal impedance, and a short transition time between open and closed states. Accordingly, an improved heat switch may be beneficial.

SUMMARY

Certain embodiments of the present invention may provide solutions to the problems and needs in the art that have not yet been fully identified, appreciated, or solved by conventional heat switches. For example, some embodiments of the present invention pertain to an active gas-gap heat switch that significantly reduces the time required to transition between the open and closed states, reduces the heat require to warm the getter, and reduces the heat that leaks from the getter to the switch body—a factor that is very important to the efficiency of low temperature refrigerators.

In an embodiment, an apparatus includes a first thermal interface at one end of the apparatus including a plurality of fins. The apparatus also includes a getter assembly hermetically attached to the first thermal interface and a containment tube surrounding and housing the plurality of fins.

In another embodiment, a heat switch includes a first thermal interface at one end of the heat switch including a plurality of fins and a second thermal interface at another end of the heat switch including a plurality of fins. The heat switch also includes a getter assembly hermetically attached to the first thermal interface and a containment tube surrounding and housing the plurality of fins of the first thermal interface and the second thermal interface. The plurality of fins of the first thermal interface and the plurality of fins of the second thermal interface extend into the containment tube from opposite ends of the heat switch.

In yet another embodiment, an active gas-gap heat switch includes a first thermal interface at one end of the active gas-gap heat switch including a plurality of fins having a triangular shape and a second thermal interface at another end of the active gas-gap heat switch including a plurality of fins having a triangular shape. The active gas-gap heat switch also includes a containment tube surrounding and housing the plurality of fins of the first thermal interface and the second thermal interface. The plurality of fins of the first thermal interface and the plurality of fins of the second thermal interface are alternatingly interleaved with the plurality of fins of the second thermal interface such that the fins do not physically touch one another and with the exception of two outermost fins, each fin is surrounded by two fins from the opposite thermal interface.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
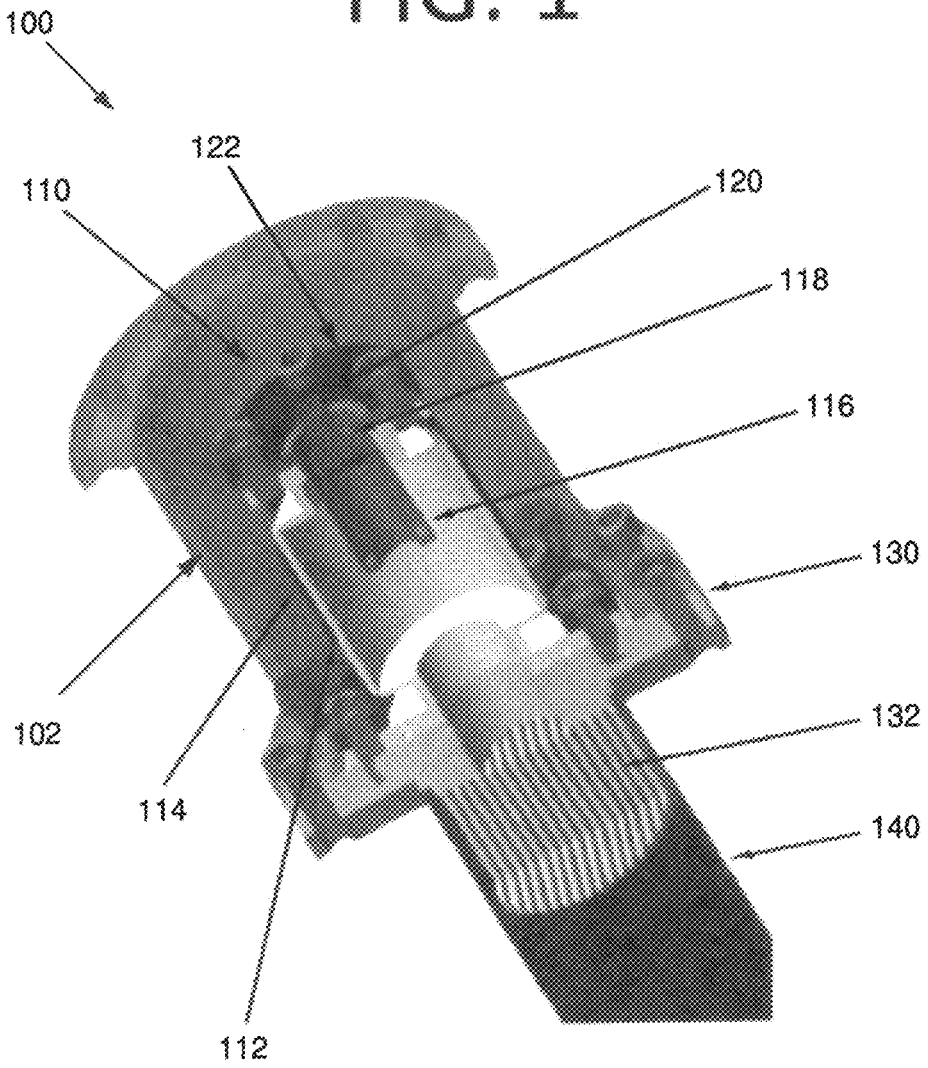
FIG. 1 is a cutaway perspective view illustrating an end of an active gas-gap heat switch with a getter assembly, according to an embodiment of the present invention.

Some embodiments of the present invention pertain to an active gas-gap heat switch that significantly reduces the time required to transition between the open and closed states, reduces the heat require to warm the getter, and reduces the heat that leaks from the getter to the switch body. Some embodiments accomplish these goals, in part, by eliminating the interconnecting tube of conventional active gas-gap heat switches and using an intermediate heat sink to keep heat away from the switch body. In some embodiments, there are essentially three regions for the switch: each end with conductive fins and the warming/cooling portion (i.e., the switch body or getter assembly). Thermally conductive fins, which may be rectangular, triangular, straight, curved, or any other shape or combination of shapes in some embodiments, may be located in a containment tube.

"Fingers" made up of the thermally conductive fins may come from both ends of the switch with some from one end and some from the other. For instance, half of the fins may come from one end and half may come from the other. Furthermore, in certain embodiments, the fins from each side are interleaved such that with the exception of the outermost two fins, each fin is surrounded by two fins from the opposite end of the containment tube. While the fins are interleaved, they do not touch. The switch is considered "on" based on when helium gas is present between the fins (i.e., it has been desorbed from the getter) and "off" when the helium gas is comparatively absent between the fins (i.e., it has been adsorbed onto the getter). When there is helium gas between the fins, it can exchange heat. It is desirable to have a large amount of surface area of the fins available for helium to exchange heat and for the space between the fins to be as small as reasonably possible without the fins touching from vibration. As such, a goal of some embodiments is generally to achieve the highest possible surface area and the shortest practicable distance between fins.

In some embodiments, copper may be used for the fins. Copper never goes superconducting by itself and is relatively easy to make pure. However, any material that is highly thermally conductive may be used. Aluminum, for instance, may be a good candidate for certain applications, but it becomes superconducting below 1.2 K. This turns a good conductor to a very poor thermal conductor. As such, the material should be selected based on the operating temperature and the thermal conductivity properties of the material.

In order to effectively conduct heat, the switch should be as thermally conductive as possible when "on." Conversely, the switch should be as insulated as possible when "off." The getter assembly is the structure that controls whether gas is in gas phase or plated out on some other surface. At low temperature, any surface in switch has some binding energy. For helium, a getter material, such as charcoal, is placed the inside of the getter assembly. Charcoal has a very fine microscopic structure and carbon has unusually strong binding energy for helium. As such, it is a particularly effective choice for a getter material. However, any other material with a strong binding energy for helium or any other suitable gas (e.g., nitrogen for operation in the vicinity of 50 K, neon for operation in the vicinity of 20 K, etc.) may be used based on the desired operating temperature and application.

If charcoal cools to 1 K, the helium atoms will try to become stuck on the surface thereof. When any gas is close to temperature where it would condense on itself, it will condense on surfaces, but a strong binding energy is still desirable. If the temperature is warmed to, e.g., 8-10 K by a copper heater or other suitable heater, however, some atoms go back into the gas phase and flow between the fins.

It is not desirable to have the power that it takes to perform the warming in the thermal path of the system. For instance, heat that leaks into an associated refrigerator needs to be dealt with, adding to the refrigerator's cooling load and decreasing operational efficiency and effectiveness. In other words, the cooling capacity of refrigerator must be used to remove waste heat that leaks in from the switch.

Some embodiments may be used in redundant or multi-stage systems having multiple refrigerators. For instance, a switch of some embodiments could be included between each pair of refrigerators in a series linear configuration where the end refrigerators are connected to one other refrigerator and all other refrigerators are connected to two other refrigerators. In certain embodiments, the refrigerators may connected in a ring configuration, where each refrigerator is connected to two others. Such systems may be useful for terrestrial and/or space applications. For multi-stage systems, whatever heat leak that is incurred is folded up and more heat that your system has to pump out, causing a multiplicative effect.

FIG. 1 is a cutaway perspective view illustrating an end of an active gas-gap heat switch 100 with a getter assembly 110, according to an embodiment of the present invention. Getter assembly 110 attaches hermetically to one end of heat switch 100 at a thermal interface 130, thus eliminating the interconnecting tube. Getter assembly 110 includes thin-wall bellows 112 (e.g., stainless steel bellows) inside a support 114 (e.g., plastic such as Vespel™), a flanged connection 122 between bellows 112 and a re-entrant tube 116 (e.g., a Ti15333 low thermal conductance titanium alloy tube), and a copper closeout 118. Getter material is bonded to copper closeout 118 on the inside of re-entrant tube 116, while a heater and thermometer to activate the switch (not shown) are bonded to the outside of getter assembly 110 via a mount 120. In this view, the slice for the cutaway view is made slightly off center and toward the viewer. As such, it does not pass through copper closeout 118.

A key feature of some embodiments is that flanged connection 122 between bellows 112 and re-entrant tube 116 can be thermally anchored to a temperature node (not shown) that is intermediate between the body temperature of heat switch 100 and the temperature of the getter bonded to copper closeout 118. This would typically be the heat sink for the low temperature refrigerator. The purpose of this connection is to conduct most of the heat used to warm the getter to this intermediate sink (i.e., the temperature node) rather than to a body 102 of switch 100. Only a small amount of heat leaks through bellows 112 and support 114 to body 102 of switch 100. Rather, most of the heat flows down re-entrant tube 116 and down containment tube 140, between thermally conductive fins 132, rather than into the switch body. As such, almost no heat is conducted towards the switch body.

Some advantages of the embodiment shown in FIG. 1 include, but are not limited to, the following. First, the open geometry of getter assembly 110 and the connection to switch body 102 create a very low gas impedance path between the getter and the interior of switch body 102. Second, the mass of copper closeout 118 and the attached instrumentation is very small, resulting in a very low heat capacity. The thermal conductance of re-entrant tube 116 is also very small, requiring very low power to warm the getter. However, even though the thermal conductance is small, the thermal time constant of the getter and copper closeout 118 is still significantly smaller than that of conventional designs. For instance, some embodiments have a thermal time constant of 30 seconds or less, compared to 1-2 minutes for conventional switches. Finally, bellows 112 and support 114 have a very low combined thermal conductance, so that the heat flow from the intermediate heat sink (connected to the flange joining bellows 112 to re-entrant tube 116) is exceedingly small. Accordingly, this embodiment allows all design goals for active gas-gap heat switches to be met without having to compromise between them.

In some embodiments, the fins are triangular in shape such that they taper to a point at the end opposite the flange. One reason for such a configuration is that for any vibration, the long, thin fins may vibrate enough to touch each other in rectangular or other wide-ended shapes. These fins may be 7-8 cm in some embodiments and may move sufficiently to touch an adjacent fin with a relatively small force, such as someone bumping the unit. The touching of the fins causes momentary heat conduction that could crash the system. Triangular fins are much stiffer than rectangular or other wide-ended shapes.

When the switch is off and there is little or no helium gas between the fins, the only substantially thermally conducting component is the containment tube that surrounds the fins. As such, it is desirable to have the containment tube be as minimally thermally conductive as possible when the switch is off.

Unfortunately, many of the best materials for low thermal conductivity, such as certain metals, carbon fiber, composites, certain plastics, etc., are very permeable to helium at room temperature. During construction, helium gas diffuses through the material. As such, one must choose whether it is more preferable to make the tube more hermetic or live with more thermal conductance. The risk of losing helium is so high that all metal structures are generally used to ensure that the helium gas does not escape. These metal structures have relatively high thermal conductance, and the heat that enters the system creates inefficiencies.

To address this issue, some embodiments use nested containment tubes. For instance, in an embodiment with three tubes, the outer tube may seal to the middle tube at one end, and the inner tube may seal to the middle tube at the other end. The nested containment tubes house the fins. The nested tubes may be made of the same minimally thermally conductive material in some embodiments. For instance, the containment tubes may be made from titanium 15333, which is the lowest thermal conductivity metal yet identified. The re-entrant geometry gives a much longer thermal path length in the nested tube configuration. This provides some relief on finding a material with very low thermal conductivity, and materials other than titanium 15333 may also be used.

Figure 2A:
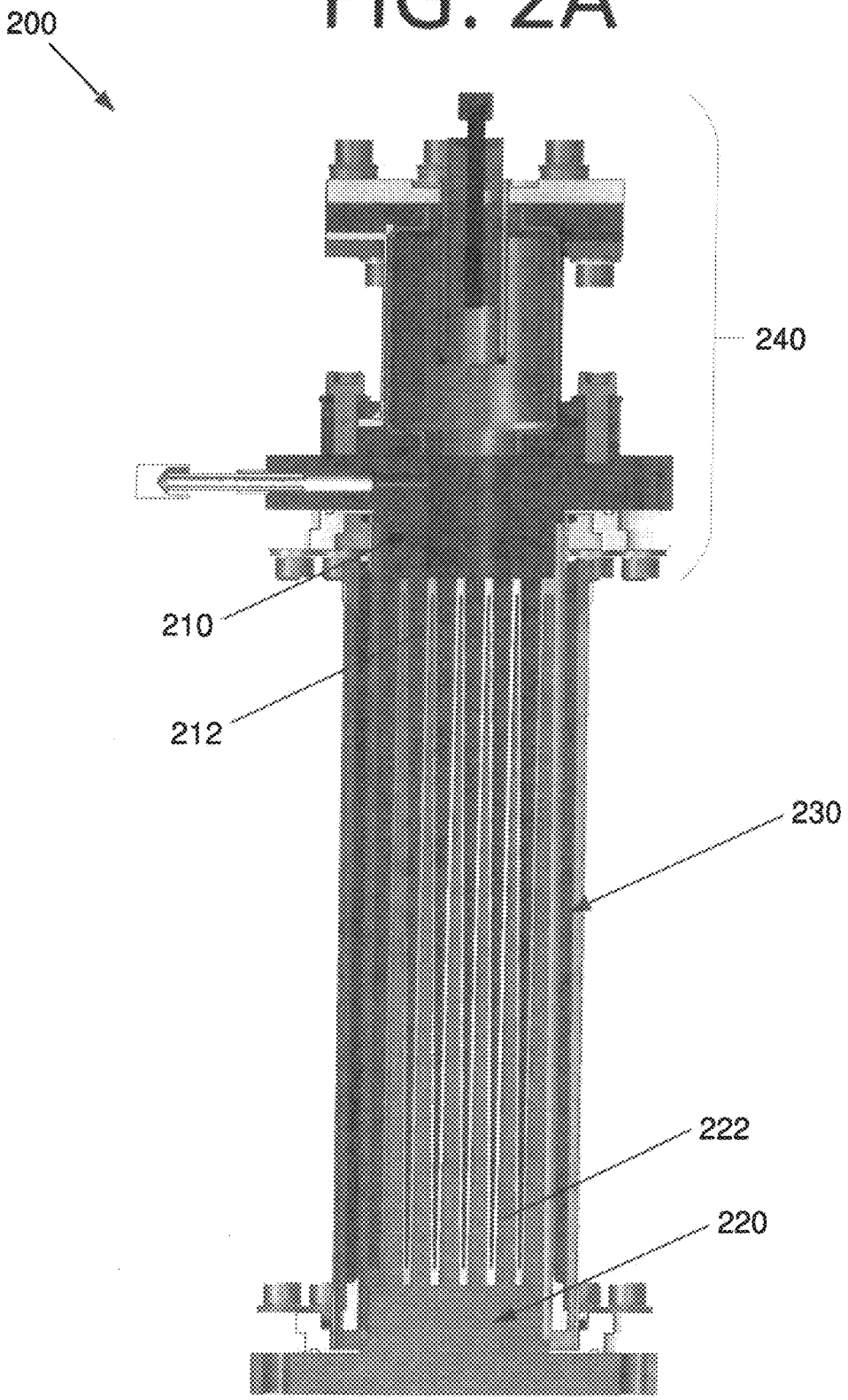
FIG. 2A is a side cutaway view illustrating an active gas-gap heat switch, according to an embodiment of the present invention.

FIG. 2A is a side cutaway view illustrating an active gas-gap heat switch 200, according to an embodiment of the present invention. Active gas-gap heat switch 200 includes an upper thermal interface 210 with associated thermally conductive, tapered triangular fins 212 (shown in darker gray), a lower thermal interface 220 with associated thermally conductive, tapered triangular fins 222 (shown in lighter gray), and a nested containment tube 230. Active gas-gap heat switch 200 also includes a getter section 240.

The two sets of fins 212, 222 may be cut from a single piece of copper using a technique called wire electric discharge machining (EDM) in some embodiments. Basically, a brass wire is electrified and guided through a solid copper blank, zig-zagging back and forth to trace the path shown in FIG. 2A. This produces the gap between fins 212, 222, and the two sets of fins match each other.

While any suitable angle of taper is envisioned for various embodiments, the larger the angle is, the fewer fins there would be, and the less surface area that would be produced. Accordingly, some embodiments set the angle so that sufficient surface area is realized (e.g., approximately two degrees off vertical in some embodiments), and the fins are rigid enough that they will not touch under accelerations up to about 5 g. At higher accelerations, the fins will touch momentarily, but they do not bend enough to permanently deform, so they return to their original shape. In fact, in certain embodiments such as those with an angle of two degrees off vertical, the deformation will be plastic even at higher accelerations.

Figure 2B:
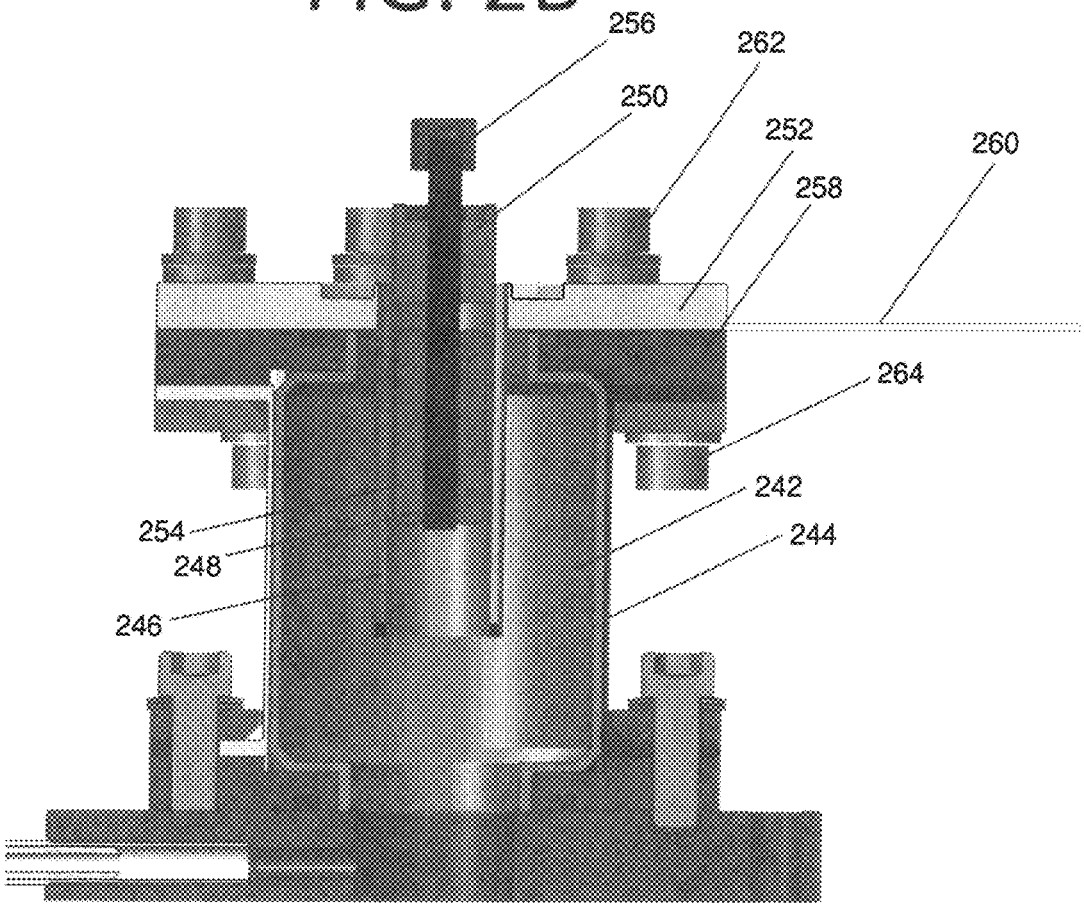
FIG. 2B is a side cutaway view illustrating the getter section of the active gas-gap heat switch, according to an embodiment of the present invention.

FIG. 2B is a side cutaway view illustrating getter section 240 of active gas-gap heat switch 200, according to an embodiment of the present invention. Getter section 240 attaches hermetically to one end of active gas-gap heat switch 200 at thermal interface 210. Getter section 240 includes thin-wall bellows 242 (e.g., stainless steel bellows) inside a support 244 (e.g., plastic such as Vespel™), a first flanged connection 252 between bellows 242 and a re-entrant tube 246 (e.g., a Ti15333 low thermal conductance titanium alloy tube), and a copper closeout 248 that is sealed to re-entrant tube 246 via an interface ring 250. Getter 254 is bonded to copper closeout 248 on the inside of re-entrant tube 246, while a heater and thermometer 256 to activate the switch are bonded to the outside of copper closeout 248.

A key feature of some embodiments is that flanged first connection 252 between bellows 242 and re-entrant tube 246 can be thermally anchored via a strap 260 to a temperature node (not shown) that is part of the external system in which active gas-gap heat switch 200 is used. The temperature node is intermediate in temperature between the body temperature of active gas-gap heat switch 200 and the temperature of getter 254, and heat transfers between the temperature node and getter section 240 via strap 260. The temperature node would typically be the heat sink for the low temperature refrigerator.

Strap 260 can be any suitable form of thermally conductive material in some embodiments, e.g., a thin strip of metal, a braid, a wire, or any suitable bundle of conductive elements. The attachment to first flanged connection 252 can be made many ways, for example by placing strap 260 under a screw, such as screw 262 or screw 264, that clamps first flanged connection 252 to second flanged connection 258. Additionally or alternatively, strap 260 may be bonded on using epoxy or another suitable adhesive in some embodiments.

The purpose of this connection is to conduct most of the heat used to warm getter 254 to this intermediate sink rather than to a body of active gas-gap heat switch 200. Only a small amount of heat leaks through bellows 242 and support 244 to the body of active gas-gap heat switch 200. Rather, most of the heat flows down re-entrant tube 246 and down containment tube 230, between thermally conductive fins 212, rather than into the body of active gas-gap heat switch 200. As such, almost no heat is conducted towards the body of active gas-gap heat switch 200.

Figure 2C:
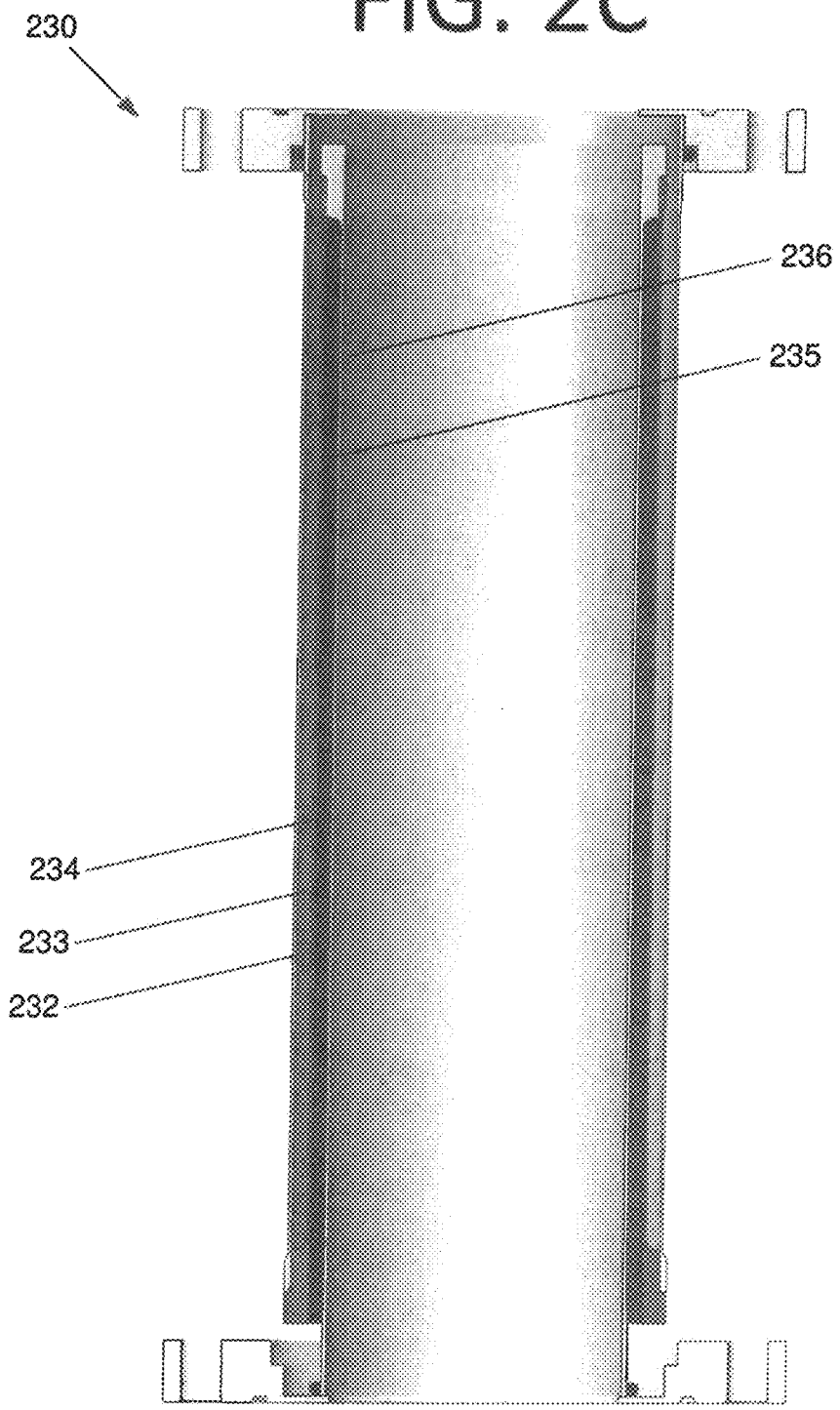
FIG. 2C is a side cutaway view illustrating the nested containment tube of the active gas-gap heat switch, according to an embodiment of the present invention.

FIG. 2C is a side cutaway view illustrating nested containment tube 230 of the active gas-gap heat switch, according to an embodiment of the present invention. Nested containment tube 230 has a re-entrant geometry in this embodiment. Nested containment tube 230 includes three tubes in this embodiment: an outer tube 232, a middle tube 234, and an inner tube 236. Gaps 233, 235 are present between outer tube 232 and middle tube 234, and between middle tube 234 and inner tube 236, respectively. However, any number of tubes may be used without deviating from the scope of the invention. The location of tubes 232, 234, 236 and gaps 233, 235 is more easily visible in FIGS. 2D and 2E.

Figure 2D:
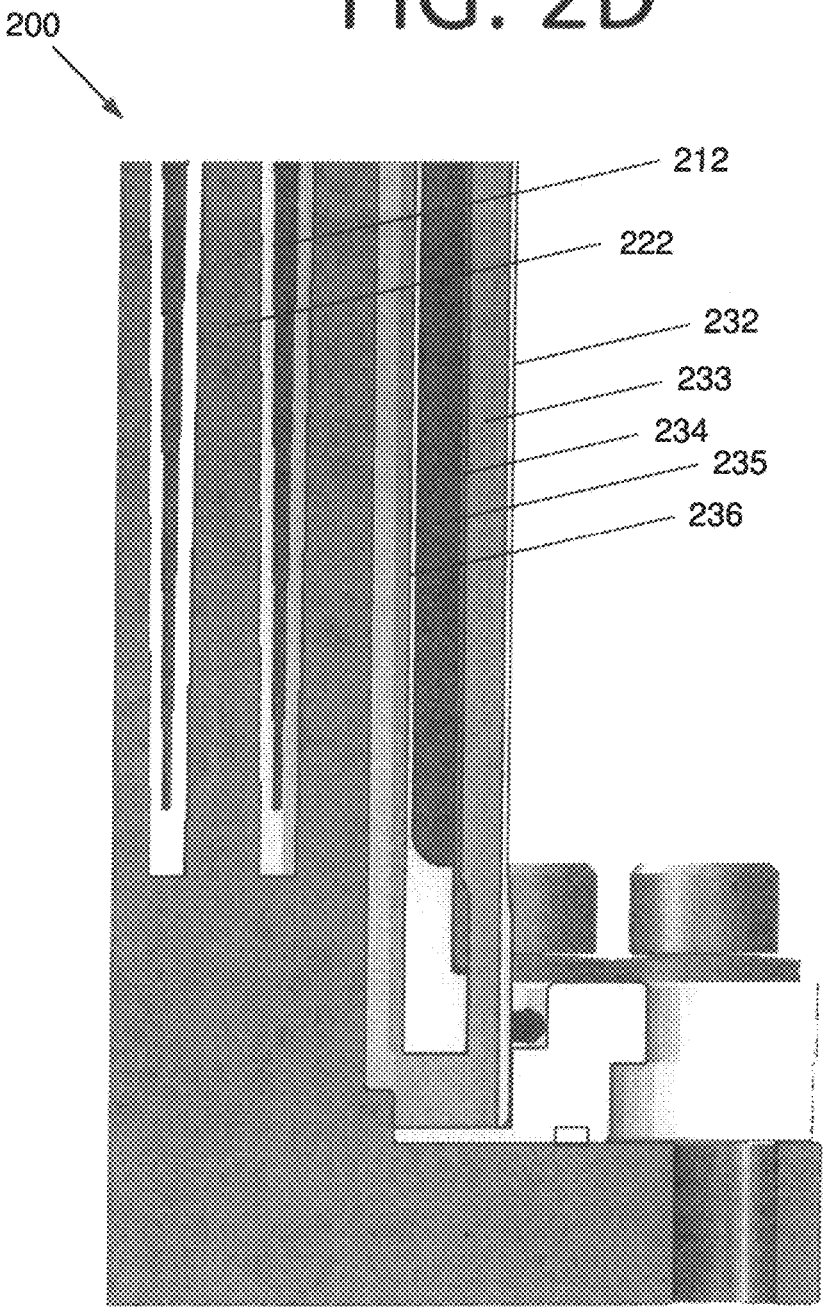
FIG. 2D is a side cutaway view illustrating a lower re-entrant weld of the nested containment tube, according to an embodiment of the present invention.
Figure 2E:
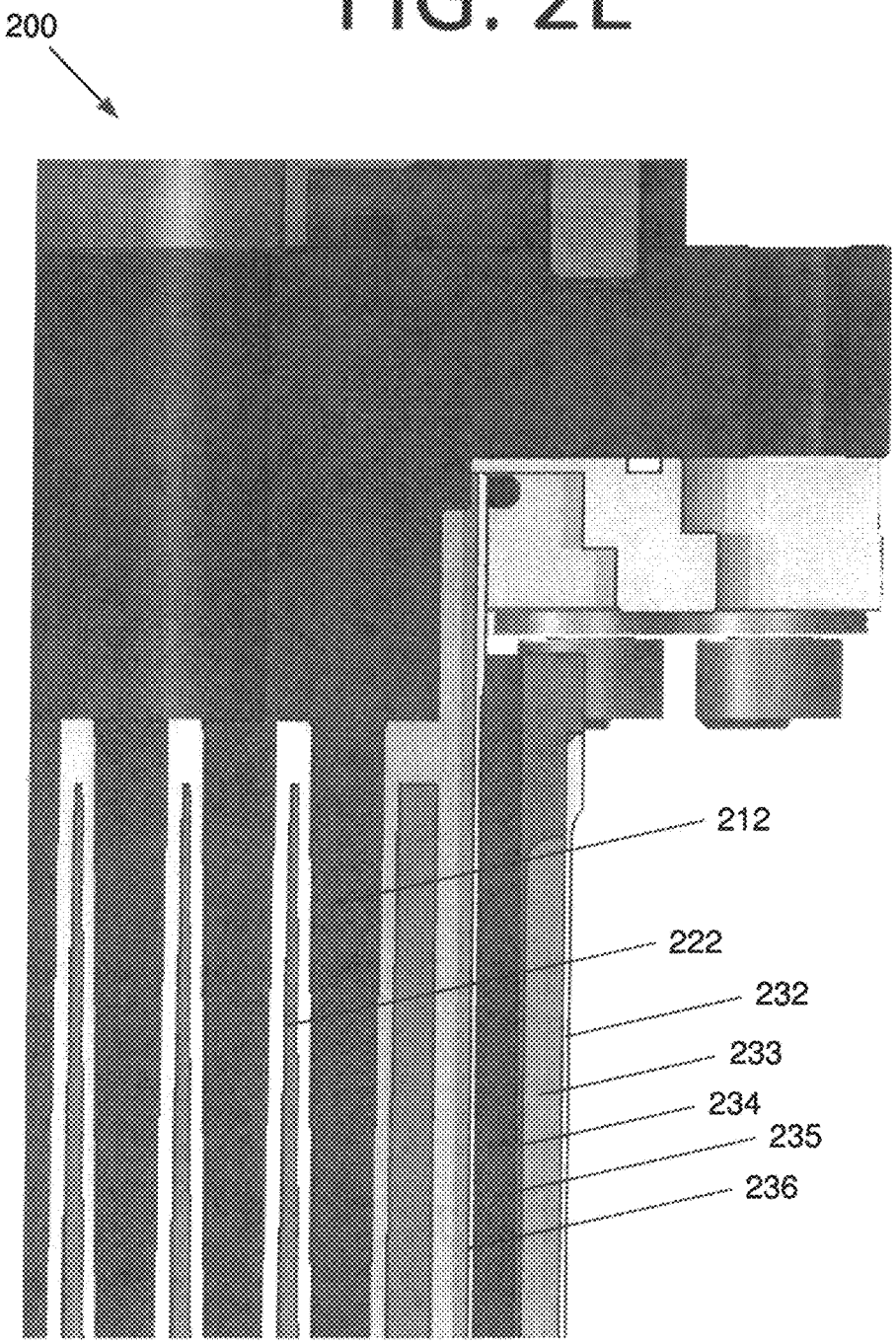
FIG. 2E is a side cutaway view illustrating an upper re-entrant weld of the nested containment tube, according to an embodiment of the present invention.

FIG. 2D is a side cutaway view illustrating a lower re-entrant weld of nested containment tube 230 and FIG. 2E is a side cutaway view illustrating an upper re-entrant weld of nested containment tube 230, according to an embodiment of the present invention. Outer tube 232 seals to middle tube 234 at the upper re-entrant weld and inner tube 236 seals to middle tube 234 at the lower re-re-entrant weld. Nested containment tube 230 houses fins 212, 222. Outer tube 232, middle tube 234, and inner tube 236 may be made of the same minimally thermally conductive material in some embodiments. For instance, tubes 232, 234, 236 may be made from titanium 15333, which is the lowest thermal conductivity metal yet identified. The re-entrant geometry of nested containment tube 230 gives a much longer thermal path length than a non-nested tube configuration. This provides some relief on finding a material with very low thermal conductivity, and materials other than titanium 15333 may also be used.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A heat switch, comprising:

a first thermal interface at one end of the heat switch comprising a plurality of fins;

a second thermal interface at another end of the heat switch comprising a plurality of fins;

a getter assembly hermetically attached to the first thermal interface; and a containment tube surrounding and housing the plurality of fins of the first thermal interface and the second thermal interface, wherein the plurality of fins of the first thermal interface and the plurality of fins of the second thermal interface extend into the containment tube from opposite ends of the heat switch; wherein the getter assembly comprises:

a support;

bellows positioned inside the support; and a re-entrant tube positioned inside the bellows and connected to the bellows via a flanged connection thermally anchored between a heat switch and a getter of the getter assembly.

2. The heat switch of claim 1, wherein the plurality of fins of the first thermal interface are interleaved with the plurality of fins of the second thermal interface such that the fins do not physically touch one another.

3. The heat switch of claim 1, wherein the plurality of fins of the first thermal interface and the second thermal interface are triangular in shape, coming to a point at an end opposite a respective thermal interface.

4. The heat switch of claim 1, wherein the containment tube comprises a plurality of nested tubes having a re-entrant geometry.

* * * * *